US007106982B2

(12) United States Patent
Ishii

(10) Patent No.: US 7,106,982 B2
(45) Date of Patent: Sep. 12, 2006

(54) DEVELOPER CARTRIDGE AND IMAGE FORMING APPARATUS

(75) Inventor: Makoto Ishii, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/172,990

(22) Filed: Jul. 5, 2005

(65) Prior Publication Data

US 2006/0002725 A1 Jan. 5, 2006

(30) Foreign Application Priority Data

Jul. 5, 2004 (JP) ..... 2004-198507

(51) Int. Cl.
*G03G 15/08* (2006.01)

(52) U.S. Cl. ..... 399/27; 399/111

(58) Field of Classification Search ..... 399/27, 399/30, 119

See application file for complete search history.

(56) References Cited

U.S. PATENT DOCUMENTS

| | | | | |
|---|---|---|---|---|
| 4,197,813 A | 4/1980 | Yano et al. | | |
| 5,475,469 A | 12/1995 | Okada et al. | | |
| 5,682,574 A | 10/1997 | Oshida et al. | | |
| 2003/0086715 A1* | 5/2003 | Miura et al. | ..... | 399/27 |
| 2003/0228160 A1 | 12/2003 | Inoue et al. | | |
| 2005/0117921 A1* | 6/2005 | Ishiguro et al. | ..... | 399/27 |

FOREIGN PATENT DOCUMENTS

| | | |
|---|---|---|
| GB | 566182 | 12/1944 |
| JP | 5-165331 | 7/1993 |
| JP | 7-219412 | * 8/1995 |
| JP | 9-274384 | 10/1997 |
| JP | 2001-100507 | 4/2001 |
| JP | 2002-132034 | 5/2002 |
| JP | 2002-311701 | 10/2002 |
| JP | 2004-012893 | 1/2004 |
| JP | 2004-085649 | 3/2004 |

* cited by examiner

*Primary Examiner*—Arthur T. Grimley
*Assistant Examiner*—Joseph S. Wong
(74) *Attorney, Agent, or Firm*—Banner & Witcoff, Ltd.

(57) ABSTRACT

A developer cartridge includes: a casing that stores a developer and is provided with a window hole; a stopper nail provided adjacent to the window holes; and a window member having a transmission portion that transmits light passing through the window hole, and a stopped portion in which the stopper nail is fitted, wherein the window member is closely retained in the window hole by fitting the stopper nail in the stopped portion.

35 Claims, 9 Drawing Sheets

DEVELOPER CARTRIDGE AND IMAGE FORMING APPARATUS

BACKGROUND OF THE INVENTION

1. Field of the Invention

The present invention relates to an image forming apparatus such as a laser printer and to a developer cartridge mounted in the image forming apparatus.

2. Description of the Related Art

As a configuration for detecting the residual amount of toner in an image forming apparatus such as a laser printer, there has been heretofore known a light transmission type detection technique in which a photo interrupter having a light-emitting element and a photo acceptance element provided opposite to the light-emitting element is used for performing light irradiation to detect whether toner is present or not (e.g. see JP-A-7-219412) For example, in this technique, window holes are provided in opposite surfaces of a casing in which a developer is stored. Light-transmissive window members are fitted into the window holes respectively. A light-emitting element is provided in the outside of one of the window holes, whereas a photo acceptance element is provided in the outside of the other window hole. Light is transmitted through the casing, so that a judgment is made on the basis of the output value of the photo acceptance element as to whether toner is present or not.

SUMMARY OF THE INVENTION

In JP-A-7-219412, each window member is attached to the casing by ultrasonic welding but configuration is complicated because the window member is coinjection-molded from a light-transmissive material and a material good in deposition to the casing. Although a technique of attaching the window member by bonding or forcing-in may be conceived as another configuration for attaching the window member to the casing, there is still room for improvement in each case because management of the amount of an adhesive agent to be applied, the drying time thereof, etc. is complicated in the case of bonding and management of dimensions of parts becomes severe in the case of forcing-in.

The invention is accomplished on such circumstances and one of the objects of the invention is to provide a developer cartridge and an image forming apparatus in which each window member can be attached to a casing easily.

According to a first aspect of the invention, there is provided a developer cartridge including: a casing that stores a developer and is provided with a window hole; a stopper nail provided adjacent to the window holes; and a window member having a transmission portion that transmits light passing through the window hole, and a stopped portion in which the stopper nail is fitted, wherein the window member is closely retained in the window hole by fitting the stopper nail in the stopped portion.

According to a second aspect of the invention, there is provided an image forming apparatus including: a feeder section that feeds a sheet; an image forming section that forms an image on the sheet fed by the feeder section by use of a developer; and a developer cartridge including: a casing that stores a developer and is provided with a window hole; a stopper nail provided adjacent to the window holes; and a window member having a transmission portion that transmits light passing through the window hole, and a stopped portion in which the stopper nail is fitted, wherein the window member is closely retained in the window hole by fitting the stopper nail in the stopped portion.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

An embodiment of the invention will be described in detail hereinbelow.

Figure 1:
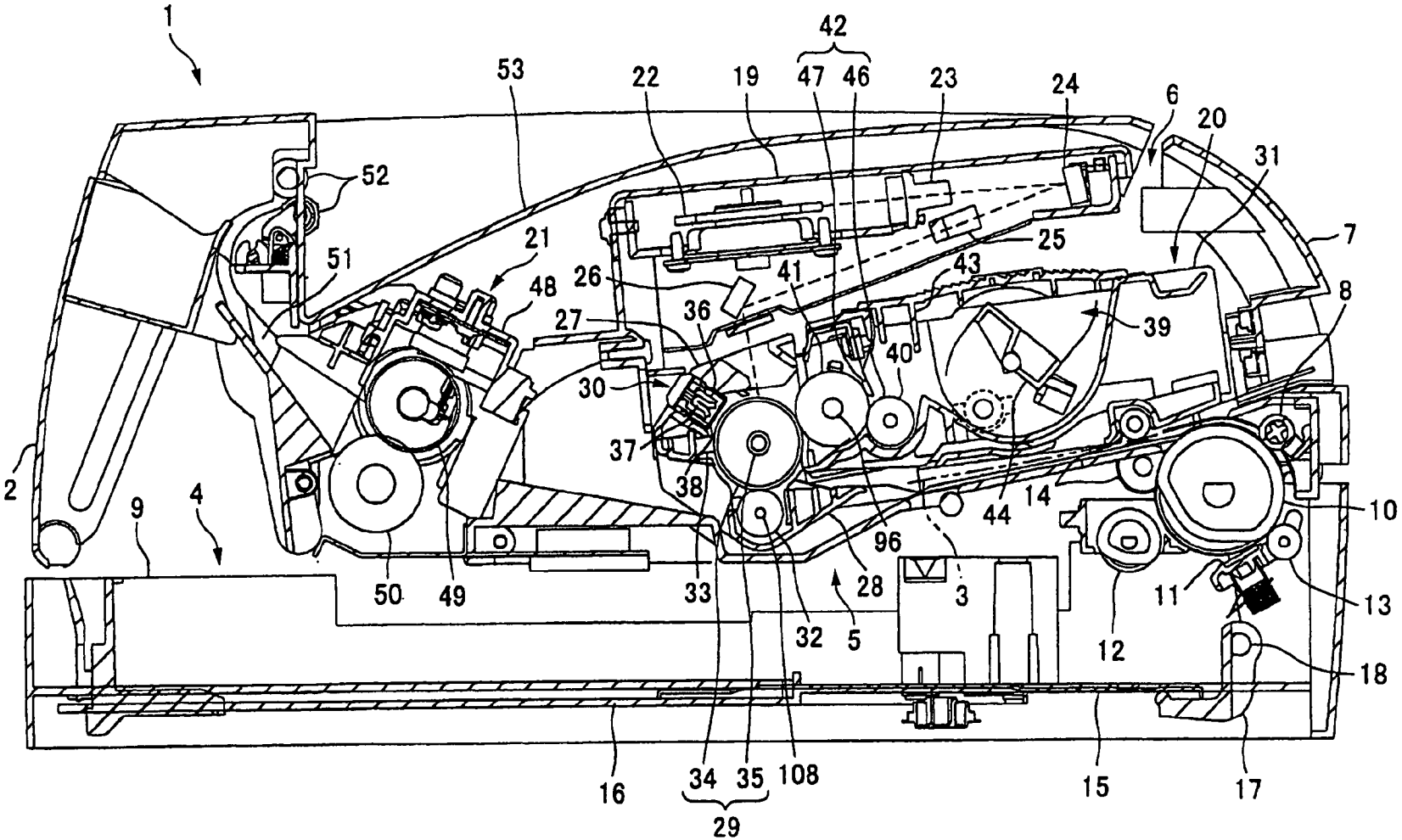
FIG. 1 is a side sectional view of important part showing an embodiment of a laser printer as an image forming apparatus according to the invention and showing a state in which a front cover is closed.
Figure 2:
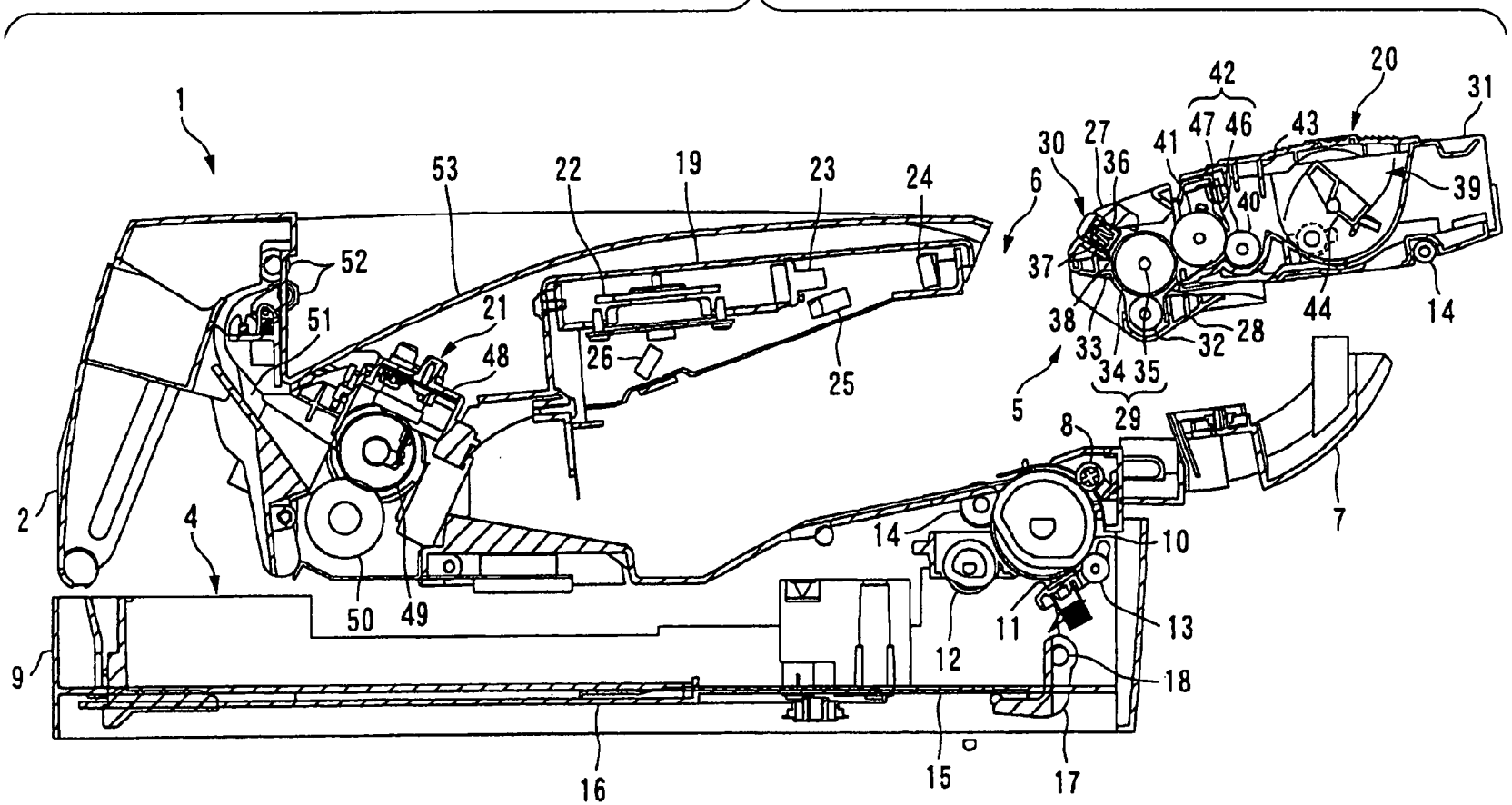
FIG. 2 is a side sectional view of important part of the laser printer depicted in FIG. 1 and showing a state in which the front cover is opened.

FIGS. 1 and 2 are side sectional views of important part showing a laser printer as an image forming apparatus according to the invention. This laser printer 1 includes a body casing 2, a feeder section 4, and an image forming section 5. The feeder section 4 and the image forming section 5 are housed in the body casing 2. The feeder section 4 is provided for feeding a sheet of paper 3 as a transfer medium. The image forming section 5 is provided for forming an image on the fed sheet of paper 3.

An insertion hole 6 is formed in a side wall of the body casing 2 so that a process cartridge 20 which will be described later can be attached/detached into/from the body casing 2. A front cover 7 is provided for opening/shutting the insertion hole 6. The front cover 7 is pivotally supported by a cover shaft (not shown) passing through the front cover 7 at a lower end portion of the front cover 7. Accordingly, when the front cover 7 is shut with the cover shaft as a pivot, the insertion hole 6 is blocked with the front cover 7 as shown in FIG. 1. When the front cover 7 is opened (pulled down) with the cover shaft as a pivot, the insertion hole 6 is opened as shown in FIG. 2 so that the process cartridge 20 can be attached/detached into/from the body casing 2 through the insertion hole 6.

Incidentally, in the laser printer 1 and the process cartridge 20 which will be described later, a side on which the front cover 7 is provided in the condition that the process cartridge 20 is mounted in the body casing 2 is referred to as "front side" while a side opposite to the front side is referred to as "rear side".

The feeder section 4 has: a paper feed tray 9 detachably attached to a bottom portion in the body casing 2; a paper feed roller 10 and a separation pad 11 provided in an upper portion of a front end portion of the paper feed tray 9; a pickup roller 12 provided in the rear of the paper feed roller 10; a pinch roller 13 disposed on a lower front side of the paper feed roller 10 so as to face the paper feed roller 10; a paper dust removal roller 8 disposed on an upper front side of the paper feed roller 10 so as to face the paper feed roller 10; and a pair of registration rollers 14 provided on an upper rear side of the paper feed roller 10.

A paper pressing plate 15 is provided in the inside of the paper feed tray 9 so that sheets of paper 3 can be stacked like layers. A rear end portion of the paper pressing plate 15 is supported so that the paper pressing plate 15 can move to a loading position where a front end portion of the paper pressing plate 15 is disposed in a lower portion so that the paper pressing plate 15 is provided along the bottom plate 16 of the paper feed tray 9, and to a conveyance position where the front end potion of the paper pressing plate 15 is disposed in an upper portion so that the paper pressing plate 15 is inclined.

A lever 17 is provided in the front end portion of the paper feed tray 9 so that the front end portion of the paper pressing plate 15 can be lifted up. The lever 17 is substantially shaped like an "L" figure in section so that the lever 17 can creep under the paper pressing plate 15 from the front side of the paper pressing plate 15. An upper end portion of the lever 17 is attached to a lever shaft 18 provided in the front end portion of the paper feed tray 9. A rear end portion of the lever 17 abuts on the front end portion of the lower surface of the paper pressing plate 15. Accordingly, when force to drive the lever shaft 18 to rotate clockwise in FIGS. 1 and 2 is applied to the lever shaft 18, the lever 17 rotates with the lever shaft 18 as a fulcrum so that the rear end portion of the lever 17 lifts up the front end portion of the paper pressing plate 15 to locate the paper pressing plate 15 in the conveyance position.

When the paper pressing plate 15 is located in the conveyance position, sheets of paper 3 on the paper pressing plate 15 are pressed by the pickup roller 12 and begin to be conveyed into between the paper feed roller 10 and the separation pad 11 in accordance with the rotation of the pickup roller 12.

On the other hand, when the paper feed tray 9 is detached from the body casing 2, the front end portion of the paper pressing plate 15 is moved down by its own weight so that the paper pressing plate 15 is located in the loading position. When the paper pressing plate 15 is located in the loading position, sheets of paper 3 can be stacked like layers on the paper pressing plate 15.

The sheets of paper 3 fed into between the paper feed roller 10 and the separation pad 11 by the pickup roller 12 are fed one by one surely separately in accordance with the rotation of the paper feed roller 10 when the sheets of paper 3 are clamped between the paper feed roller 10 and the separation pad 11. The fed sheet of paper 3 passes between the paper feed roller 10 and the pinch roller 13 and is conveyed into between the registration rollers 14 after power dust is removed by the paper dust removal roller 8.

The registration rollers 14 are provided as a pair of rollers. After registration, the registration rollers 14 convey the sheet of paper 3 to a transfer position which is located between a photosensitive drum 29 and a transfer roller 32 (which will be described later) so that a toner image on the photosensitive drum 29 is transferred onto the sheet of paper 3.

The image forming section 5 has a scanner portion 19, a process cartridge 20, and a fixing portion 21.

The scanner portion 19 is provided in an upper portion in the body casing 2. The scanner portion 19 has a laser beam source not shown, a polygon mirror 22 driven to rotate, an fθ lens 23, a reflection mirror 24, a lens 25, and a reflection mirror 26. A laser beam emitted from the laser beam source and based on image data is deflected by the polygon mirror 22 as represented by the chain line. After the laser beam passes through the fθ lens 23, an optical path of the laser beam is turned by the reflection mirror 24. After the laser beam further passes through the lens 25, the optical path of the laser beam is further bent down by the reflection mirror 26. In this manner, the laser beam is applied on a surface of the photosensitive drum 29 (which will be described later) of the process cartridge 20.

Figure 4:
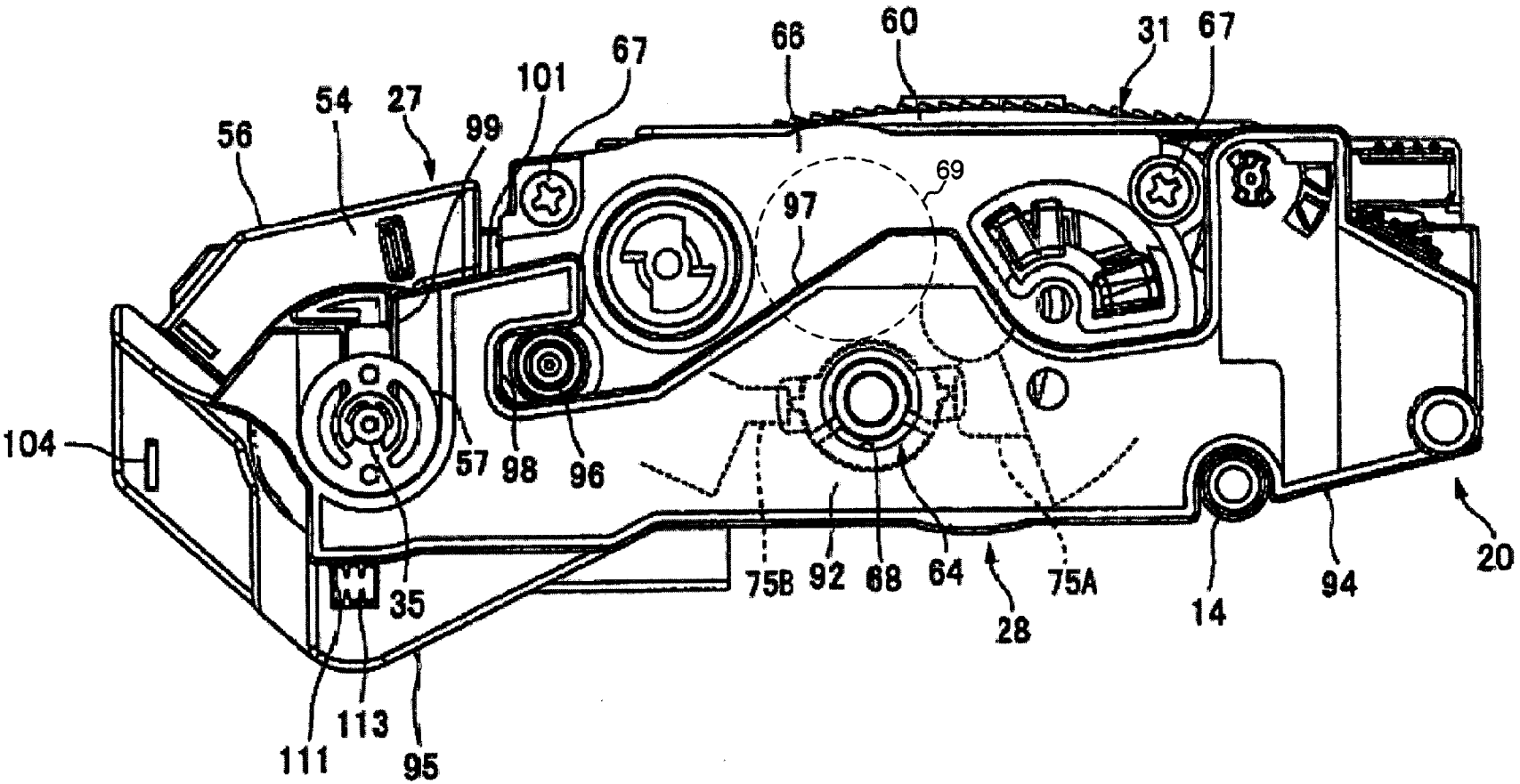
FIG. 4 is a side view of the process cartridge depicted in FIG. 1.
Figure 5:
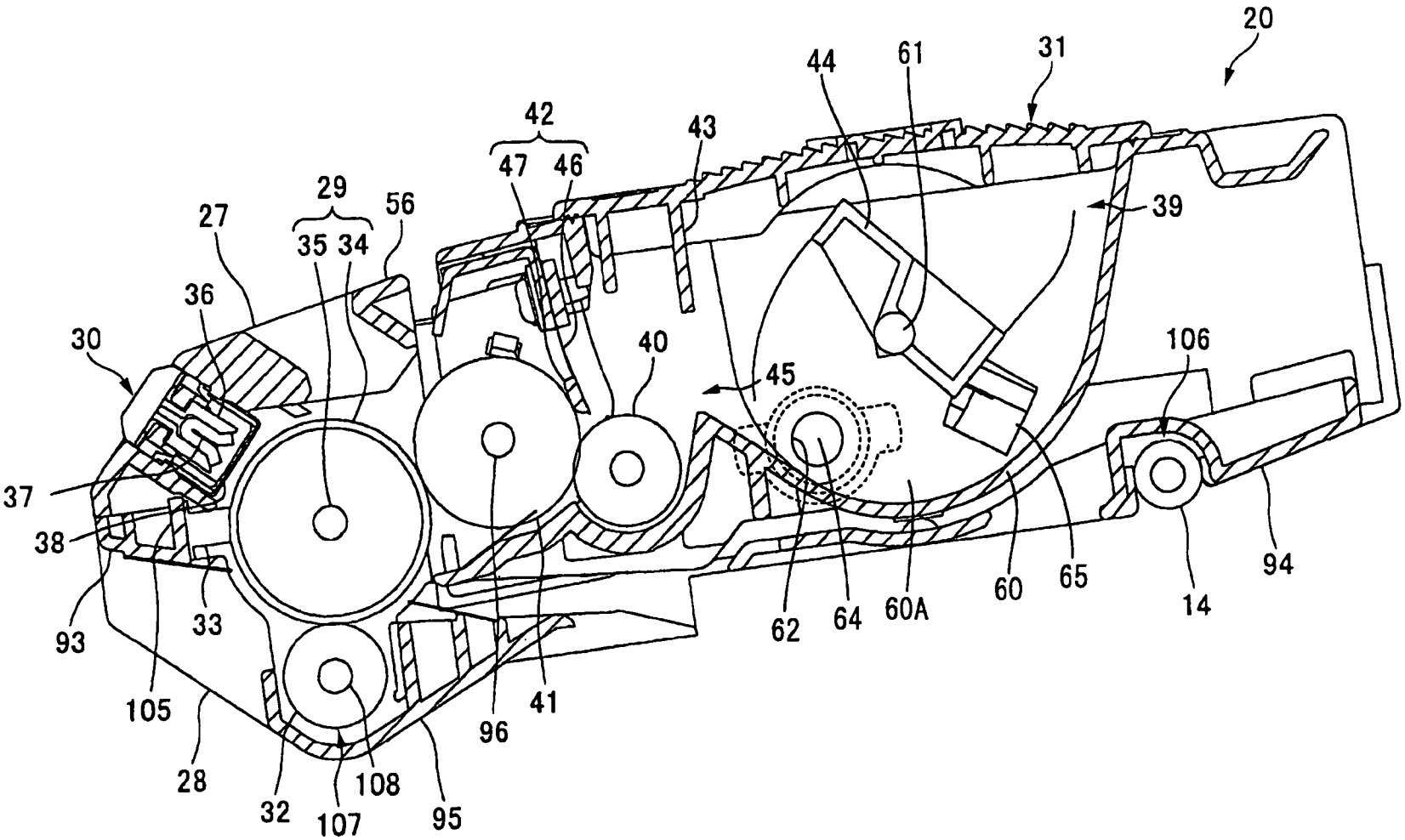
FIG. 5 is a sectional view taken along the line V—V in FIG. 3.

Below the scanner portion 19, the process cartridge 20 is detachably attached to the body casing 2. As shown in FIG. 4, the process cartridge 20 has a casing composed of an upper frame 27 as a first frame, and a lower frame 28 as a second frame formed separately from the upper frame 27 and combined with the upper frame 27. As shown in FIG. 5, the process cartridge 20 further has a photosensitive drum 29 as an image carrier, a scorotron type charger 30 as a charging means, a development cartridge 31 (which serves as a "developer cartridge"), a transfer roller 32 as a transfer means, and a cleaning brush 33. These parts 29 to 33 are provided in the casing of the process cartridge 20.

The photosensitive drum 29 has a drum body 34, and a metal drum shaft 35. The drum body 34 is shaped like a cylinder having an outermost layer provided as a positively chargeable photosensitive layer made of polycarbonate or the like. The metal drum shaft 35 is provided in the axial center of the drum body 34 so as to serve as a shaft extending along the lengthwise direction of the drum body 34. While the drum shaft 35 is supported by the upper frame 27, the drum body 34 is rotatably supported by the drum shaft 35 so that the photosensitive drum 29 can rotate with the drum shaft 35 as its center in the upper frame 27.

The scorotron type charger 30 is supported by the upper frame 27 and disposed in an oblique upper portion of the rear side of the photosensitive drum 29 so as to be opposite to the photosensitive drum 29 with a predetermined distance to prevent the scorotron type charger 30 from coming into contact with the photosensitive drum 29. The scorotron type charger 30 has a discharge wire 37, and a grid 38. The discharge wire 37 is disposed in the axial direction of the photosensitive drum 29 so as to be opposite to the photosensitive drum 29 with a predetermined distance. The grid 38 is provided between the discharge wire 37 and the photosensitive drum 29 in order to control the amount of electric discharge from the discharge wire 37 to the photosensitive drum 29. In the scorotron type charger 30, when a high voltage is applied to the discharge wire 37 so as to generate corona discharge in the discharge wire 37 while a bias voltage is applied to the grid 38, a surface of the photosensitive drum 29 can be evenly charged with static electricity of positive polarity.

Incidentally, a cleaning member 36 for cleaning the discharge wire 37 is provided in the scorotron type charger 30 so that the discharge wire 37 is clamped by the cleaning member 36.

The development cartridge 31 has a box-like casing 60. The rear side of the casing 60 can be opened so that the development cartridge 31 can be detachably attached to the lower frame 28. A toner storage chamber 39, a supply roller 40, a development roller 41 and a layer thickness limiting blade 42 are provided in the development cartridge 31.

The toner storage chamber 39 is formed as an internal space which is provided as a front portion of the casing 60 and which is obtained by partitioning the casing 60 by a partition plate 43. The toner storage chamber 39 is filled with positively chargeable non-magnetic one-component toner as a developer. For example, the toner used is polymer toner prepared by copolymerizing styrene monomers such as styrene, etc. or acrylic monomers such as acrylic acid, alkyl(C1–C4) acrylate, alkyl(C1–C4) methacrylate, etc. by means of suspension polymerization or the like. Particles of the polymer toner are substantially spherical and have very good fluidity, so that formation of a high-quality image can be achieved.

Incidentally, a coloring agent such as carbon black, etc., wax, and so on may be mixed with the toner. External additives such as silica, etc. may be added to the toner in order to improve the fluidity. The mean particle size of the toner is in a range of from about 6 to 10 μm.

An agitator 44 (which serves as an "agitating member") is provided in the toner storage chamber 39 so as to be supported by a rotation shaft 61 provided in the center of the toner storage chamber 39. The agitator 44 is driven to rotate by motive power given from a motor not shown. When the agitator 44 is driven to rotate, the toner in the toner storage chamber 39 is agitated and released from an opening portion 45 toward the supply roller 40. The opening portion 45 is provided under the partition plate 43 so as to connect front and rear spaces to each other.

As will be described later in detail, window holes 62 for detecting the residual amount of toner are provided in left and right walls 60A of the casing 60 respectively so as to be located in a region corresponding to the toner storage chamber 39. Window members 64 are mounted in the window holes 62 through sealing members 63 respectively. The window members 64 are cleaned with a wiper 65 (which serves as a "cleaning member") which is held by the agitator 44 so as to cooperate with the agitator 44. Incidentally, in the body casing 2, a light-emitting element (not shown) is provided on the outside of one window hole 62 and a photo acceptance element (not shown) is provided on the outside of the other window hole 62. Detection light emitted from the light-emitting element and passing through the inside of the casing 60 is detected by the photo acceptance element. A judgment is made in accordance with the output value of the detection light as to whether the toner remains or not.

The supply roller 40 is disposed in the rear side of the opening portion 45 and supported by the development cartridge 31 so as to be rotatable. The supply roller 40 has a roller made of an electrically conductive foaming agent, and a roller shaft made of metal and covered with the roller. The supply roller 40 is driven to rotate by motive power given from a motor not shown.

The development roller 41 is rotatably supported by the development cartridge 31 in the condition that the development roller 41 and the supply roller 40 are brought into contact with each other in the rear side of the supply roller 40 so as to be compressed. The development roller 41 is brought into contact with the photosensitive drum 29 so as to be opposite to the photosensitive drum 29 in the condition that the development cartridge 31 is attached to the lower frame 28. The development roller 41 has a roller made of an electrically conductive rubber material, and a roller shaft 96 made of metal and covered with the roller. In the front end portion of the development cartridge 31, opposite end portions of the roller shaft 96 protrude outward from sides of the development cartridge 31 in a widthwise direction perpendicular to a front-rear direction (see FIGS. 3 and 4). The roller of the development roller 41 has a roller body made of electrically conductive urethane rubber or silicone rubber containing carbon fine particles, and a coat layer made of urethane rubber or silicone rubber containing fluorine. The roller body is covered with the coat layer. At the time of development, a developing bias is applied to the development roller 41. The development roller 41 is driven to rotate in the same direction as the direction of rotation of the supply roller 40 by motive power given from a motor not shown.

The layer thickness limiting blade 42 has a blade body 46 made of a metal plate spring material, and a pressing portion 47 made of electrically insulating silicone rubber. The pressing portion 47 is provided at a front end portion of the blade body 46 and shaped like a semi-circle in sectional view. The layer thickness limiting blade 42 is disposed on the development roller 41 so as to be supported by the development cartridge 31. The pressing portion 47 is brought into forced contact with the development roller 41 by elastic force of the blade body 46.

The toner released from the opening portion 45 is supplied to the development roller 41 in accordance with the rotation of the supply roller 40. On this occasion, the toner is charged with electricity based on friction between the supply roller 40 and the development roller 41. The toner supplied onto the development roller 41 passes through between the pressing portion 47 of the layer thickness limiting blade 42 and the development roller 41 in accordance with the rotation of the development roller 41, so that the toner is carried as a thin layer having a predetermined thickness on the development roller 41.

A gear mechanism 69 (shown in dashed lines) for transmitting motive power from a motor (not shown) to respective rotation shafts of the agitator 44, the supply roller 40 and the development roller 41 is provided in a left surface of the casing 60. A cover 66 is fixed by screws 67 so that the gear mechanism 69 is covered with the cover 66.

The transfer roller 32 is supported by the lower frame 28 so as to be rotatable. The transfer roller 32 is disposed so that the transfer roller 32 is brought into contact with the photosensitive drum 29 so as to be opposite to the photosensitive drum 29 in the vertical direction to thereby form a nip between the transfer roller 32 and the photosensitive drum 29 in the condition that the upper frame 27 and the lower frame 28 are combined with each other. The transfer roller 32 has a roller made of an electrically conductive rubber material, and a roller shaft 108 made of metal and covered with the roller. At the time of transfer, a transfer bias is applied to the transfer roller 32. The transfer roller 32 is driven to rotate in a direction opposite to the direction of rotation of the photosensitive drum 29 by motive power given from a motor not shown.

The cleaning brush 33 is attached to the lower frame 28. The cleaning brush 33 is disposed so that the cleaning brush 33 and the photosensitive drum 29 are brought into contact with each other in the rear side of the photosensitive drum 29 so as to be opposite to each other in the condition that the upper frame 27 and the lower frame 28 are combined with each other.

With the rotation of the photosensitive drum 29, the surface of the photosensitive drum 29 is evenly charged with positive electricity by the scorotron type charger 30. Then, the surface of the photosensitive drum 29 is exposed to the laser beam emitted from the scanner portion 19 by means of high-speed scanning of the laser beam. In this manner, an electrostatic latent image corresponding to the image to be formed on the sheet of paper 3 is formed.

Then, when the toner carried on the development roller 41 and charged with positive electricity is brought into contact with the photosensitive drum 29 so as to be opposite to the photosensitive drum 29 in accordance with the rotation of the development roller 41, the toner is supplied to the electrostatic latent image formed on the surface of the photosensitive drum 29, that is, on an exposure portion which is part of the surface of the photosensitive drum 29 evenly charged with positive electricity and which is exposed to the laser beam so that electric potential is lowered. In this manner, the electrostatic latent image on the photosensitive drum 29 is visualized so that a toner image based on a reversal phenomenon is carried on the surface of the photosensitive drum 29.

As shown in FIG. 1, the toner image carried on the surface of the photosensitive drum 29 is then transferred onto the sheet of paper 3 by the transfer bias applied to the transfer roller 32 when the sheet of paper 3 conveyed by the registration rollers 14 passes through the transfer position between the photosensitive drum 29 and the transfer roller 32. The sheet of paper 3 onto which the toner image has been transferred is conveyed to the fixing portion 21.

Incidentally, after transfer, the residual toner remaining on the photosensitive drum 29 is collected by the development roller 41. In addition, after transfer, paper dust derived from the sheet of paper 3 and deposited on the photosensitive drum 29 is collected by the cleaning brush 33.

The fixing portion 21 is provided on the rear side of the process cartridge 20. The fixing portion 21 has a fixing frame 48, a heat roller 49, and a pressure roller 50. The heat roller 49 and the pressure roller 50 are provided in the fixing frame 48.

The heat roller 49 has a metal tube, and a halogen lamp for heating the toner. The metal tube has a surface coated with a fluororesin. The halogen lamp is provided in the metal tube. The heat roller 49 is driven to rotate by motive power given from a motor not shown.

On the other hand, the pressure roller 50 is disposed under the heat roller 49 so as to be opposite to the heat roller 49 to press the heat roller 49. The pressure roller 50 has a roller made of a rubber material, and a roller shaft made of metal and covered with the roller. The pressure roller 50 is rotated following the rotation of the heat roller 49.

In the fixing portion 21, the toner transferred onto the sheet of paper 3 in the transfer position is thermally fixed when the sheet of paper 3 passes through between the heat roller 49 and the pressure roller 50. The sheet of paper 3 on which the toner has been fixed is conveyed to a paper ejection path 51 extending vertically toward the upper surface of the body casing 2. The sheet of paper 3 conveyed to the paper ejection path 51 is ejected onto a paper ejection tray 53 formed on the upper surface of the body casing 2, by paper ejection rollers 52 provided on the upper side of the paper-ejection path 51.

Figure 3:
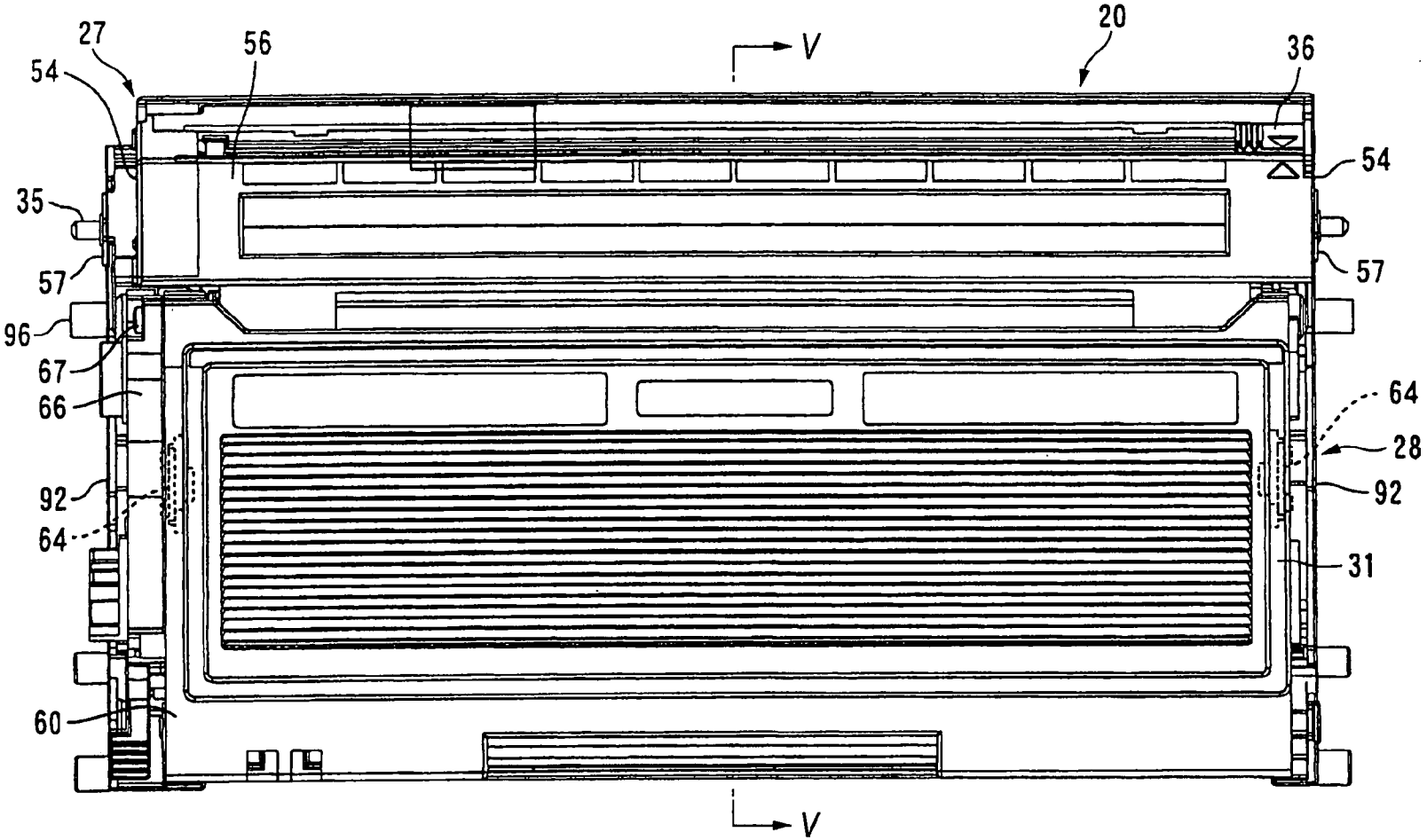
FIG. 3 is a plan view of the process cartridge depicted in FIG. 1.

FIG. 3 is a plan view of the process cartridge 20. FIG. 4 is a side view of the process cartridge 20. FIG. 5 is a sectional view taken along the line V—V shown in FIG. 3.

As shown in FIG. 3, the upper frame 27 has a pair of left and right side walls 54, and an upper wall 56. The walls 54 and 56 are integrated with one another. As shown in FIG. 5, the upper frame 27 is opened frontward and downward. Bearing members 57 are attached to opposite ends of the drum shaft 35 of the photosensitive drum 29, respectively. The drum shaft 35 is supported between the pair of side walls 54 of the upper frame 27 through the bearing members 57.

The lower frame 28 has a pair of side walls 92 (see FIG. 4), and a rear connection portion 93, a front lower connection portion 94 and a rear lower connection portion 95 (see FIG. 5) for connecting lower end lines of the side walls 92. The walls 92 and the connection portions 93 to 95 are integrated with one another. The lower frame 28 is formed so as to be opened upward.

As shown in FIG. 4, the pair of side walls 92 are disposed in the left and right so as to be opposite to each other so that the upper frame 27 and the development cartridge 31 are sandwiched between the pair of side walls 92. The side walls 92 have roller shaft guide portions 97, roller shaft receiving portions 98, and bearing member receiving grooves 99. End portions of the roller shaft 96 of the development roller 41 protruded out to left and right from the sides of the development cartridge 31 are guided by the roller shaft guide portions 97 when the development cartridge 31 is attached/detached. The roller shaft receiving portions 98 are provided at rear ends of the roller shaft guide portions 97 respectively so that the end portions of the roller shaft 96 guided by the roller shaft guide portions 97 are received in the roller shaft receiving portions 98. The bearing member receiving grooves 99 are provided in the rear of the roller shaft receiving portions 98 so that the bearing members 57 are received in the bearing member receiving grooves 99 when the upper frame 27 is attached/detached.

The roller shaft guide portions 97 are formed as upper end edges of longitudinally central portions of the side walls 92 respectively. The roller shaft guide portions 97 are formed so as to extend obliquely downward from the front to the rear and then extend substantially horizontally flatly.

The roller shaft receiving portions 98 are formed in such a manner that protrusions 101 continued to the rear sides of the roller shaft guide portions 97 and protruded upward from the rear end portions of the roller shaft guide portions 97 in the side walls 92 are substantially notched like rectangles in sectional view from the front end edges of the protrusions 101. The lower end edges of the roller shaft receiving portions 98 are continued to the rear end edges of the roller shaft guide portions 97 respectively.

A mount space in which the development cartridge 31 can be mounted is formed in front of the roller shaft receiving portions 98. When the end portions of the roller shaft 96 protruded from the sides of the development cartridge 31 are guided by the roller shaft guide portions 97, moved toward the roller shaft receiving portions 98 and received by the roller shaft receiving portions 98, the development cartridge 31 is mounted in the mount space in the condition that the roller shaft 96 is supported by the pair of side walls 92.

Incidentally, in the condition that the development cartridge 31 is mounted in the lower frame 28, the end portions of the roller shaft 96 are exposed outward in the widthwise directions of the side walls 92 through the roller shaft receiving portions 98 (see FIG. 3). When the process cartridge 20 is mounted in the body casing 2, an electrode for applying a developing bias is connected to the left end portion of the roller shaft 96. Circular through-holes 68 are provided in the side walls 92 respectively so as to be located in positions corresponding to the window holes 62 of the casing 60 in the condition that the development cartridge 31 is mounted in the lower frame 28.

The bearing member receiving grooves 99 are formed as substantially sectionally U-shaped grooves which extend vertically downward from the upper end edges of the protrusions 101 of the side walls 92 so that upper end lines are opened. The bearing members 57 are rotatably received in the lower end portions of the bearing member receiving grooves 99. In the process cartridge 20, the upper frame 27 is combined down with the lower frame 28 while the bearing members 57 are inserted in the bearing member receiving grooves 99 respectively.

An opening portion 111 for exposing a transfer electrode 113 (which will be described later) is formed below the bearing member receiving groove 99 of the left side wall 92.

A cleaning electrode 104 for applying a cleaning bias to the cleaning brush 33 is provided in the rear of the bearing member receiving groove 99 of the left side wall 92.

As shown in FIG. 5, the rear connection portion 93 connects the rear end portions of the pair of side walls 92 to each other. The rear connection portion 93 has a counter wall portion 105 which is provided in the rear of the photosensitive drum 29 and which is erected so as to be opposite to the photosensitive drum 29. The cleaning brush 33 is attached to the counter wall portion 105.

The front lower connection portion 94 connects the front portions of the lower end edges of the pair of side walls 92 to each other. The front lower connection portion 94 has a registration roller storage portion 106 in which one (upper) of the registration rollers 14 is stored.

As shown in FIG. 4, the rear lower connection portion 95 provided below the bearing member receiving grooves 99 connects the rear portions of the lower end edges of the pair of side walls 92 to each other. As shown in FIG. 5, the rear lower connection portion 95 has a transfer roller storage portion 107 in which the transfer roller 32 is stored. Roller bearings which are not shown but bear opposite end portions of the roller shaft 108 of the transfer roller 32 are provided in widthwise opposite end portions of the transfer roller storage portion 107 in the rear lower connection portion 95. The transfer roller 32 is rotatably supported by the rear lower connection portion 95 while the opposite end portions of the roller shaft 108 are borne by the roller bearings.

The left end portion of the roller shaft 108 and the transfer electrode 113 for applying a transfer bias are disposed so as to come into contact with each other. The transfer electrode 113 is exposed outward in the left through the hole 111 of the left side wall 92.

Figure 6:
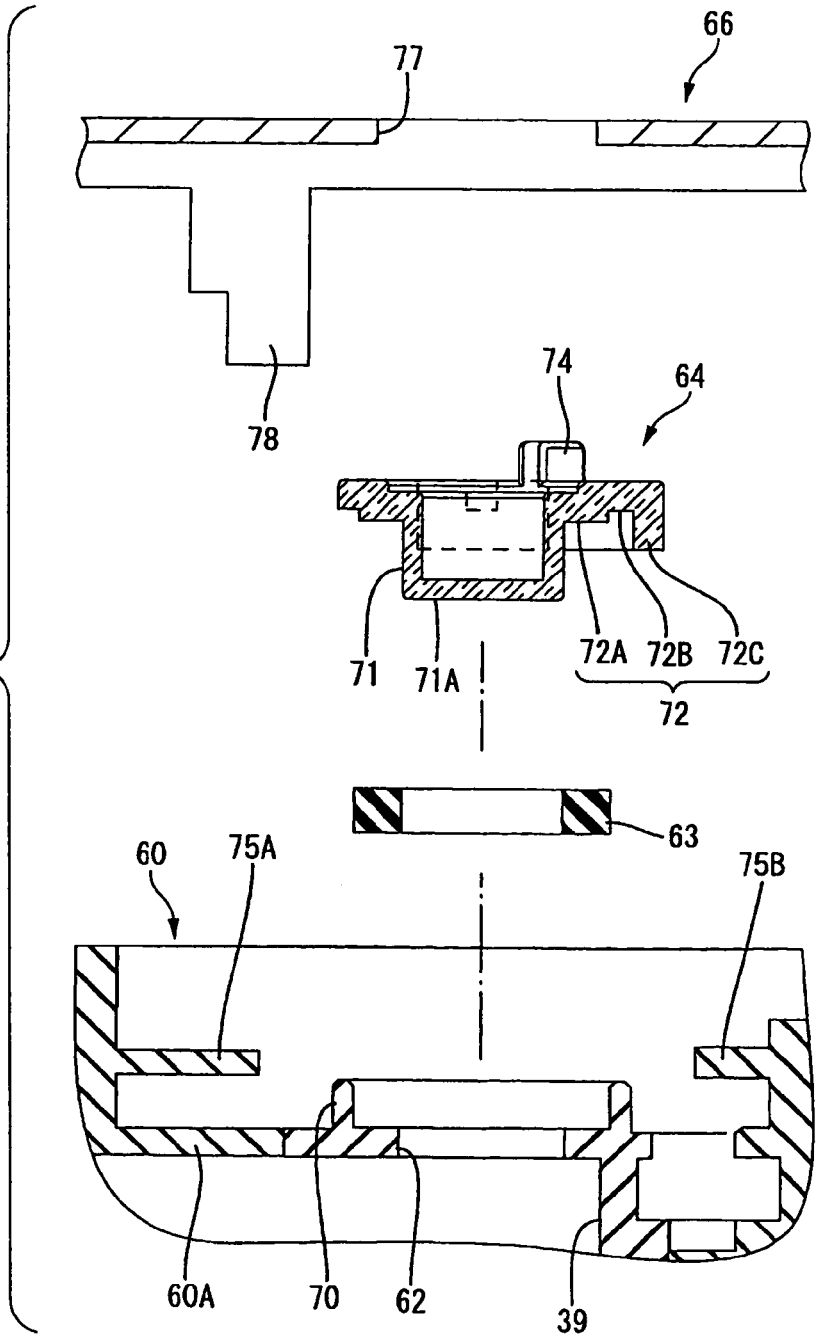
FIG. 6 is an exploded sectional view of important part showing a casing, a sealing member, a window member and a cover.
Figure 7C:
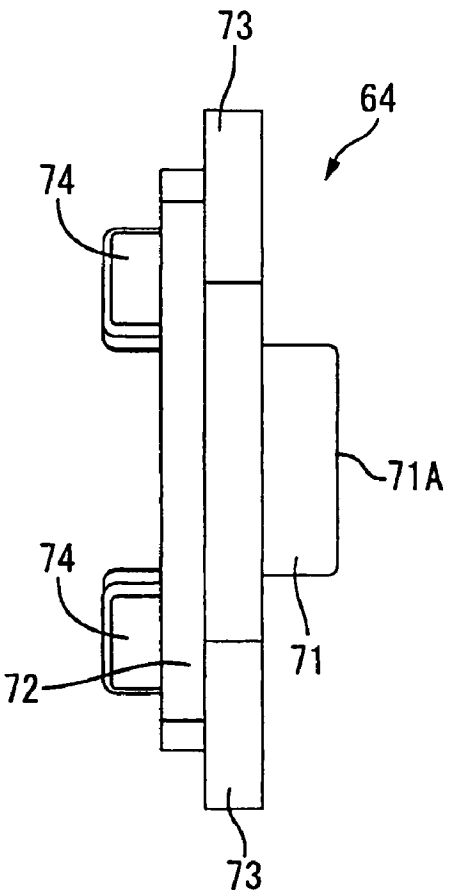
FIG. 7C is a view of the window member from a direction perpendicular to the center axis of rotation of the window member.
Figure 7B:
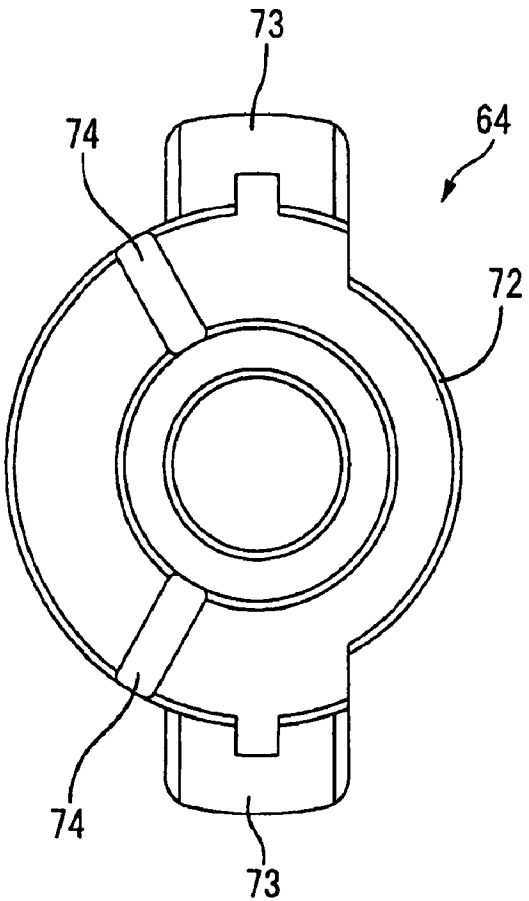
FIG. 7B is a view of the window member from a side reverse to the surface to be attached to the casing.
Figure 7A:
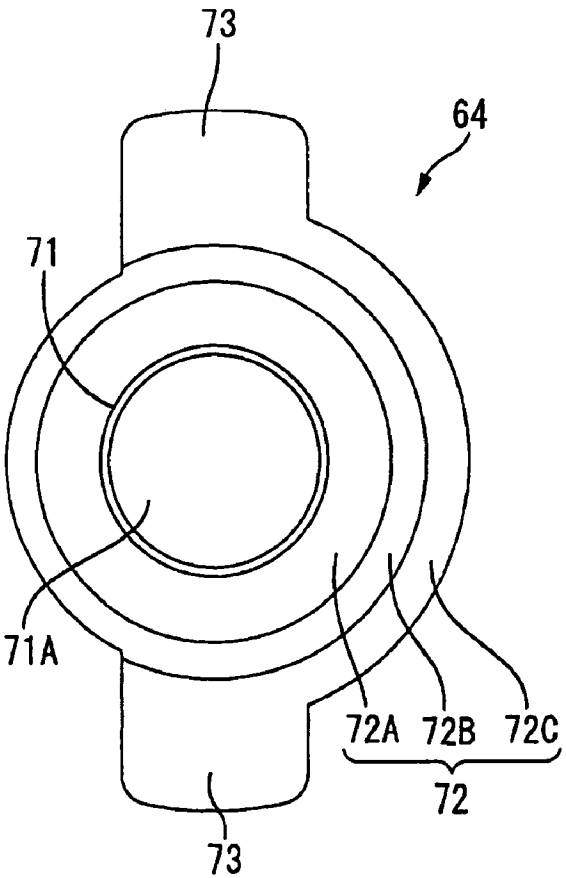
FIG. 7A is a view of the window member from a surface to be attached to the casing.
Figure 8:
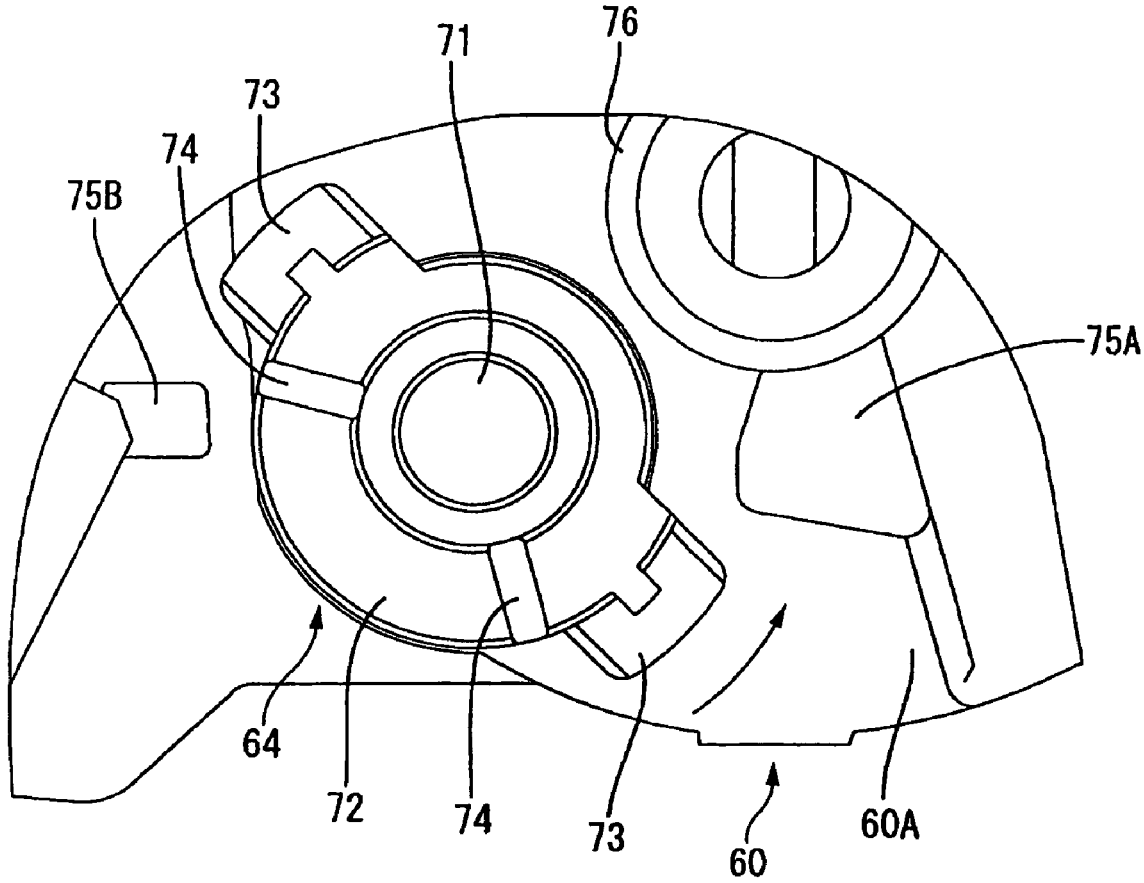
FIG. 8 is a side view showing a state in which the window member located in a non-engagement position is attached to the casing.
Figure 9A:
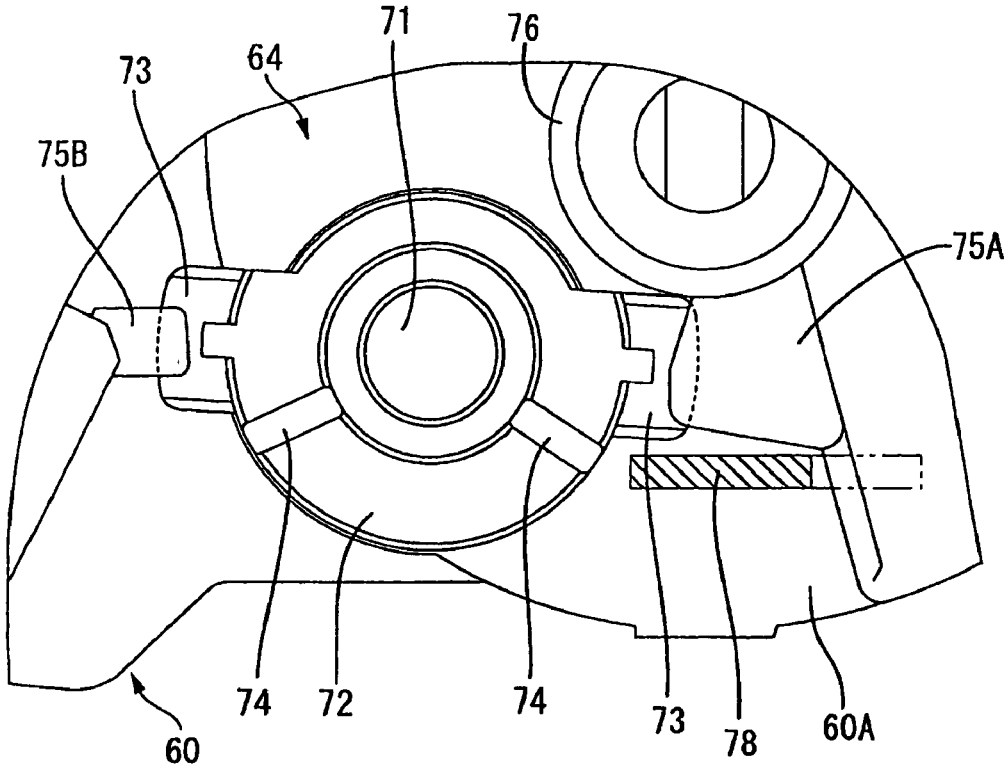
FIG. 9A is a side sectional view showing a state in which the window member located in an engagement position is attached to the casing.
Figure 9B:
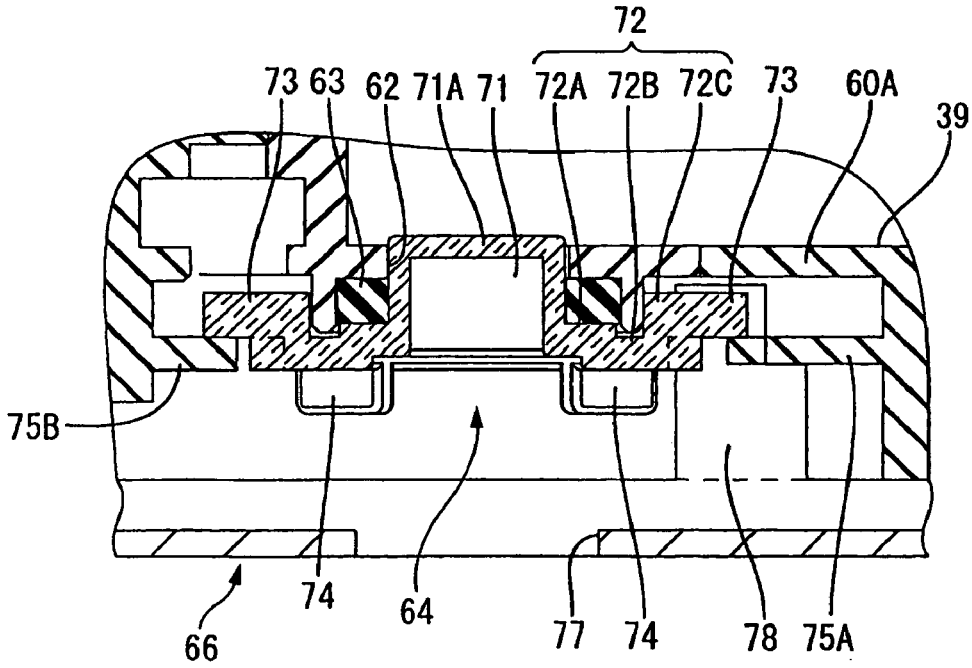
FIG. 9B is a sectional view of the window member.

FIG. 6 is an exploded sectional view showing the casing 60, the sealing member 63, the window member 64 and the cover 66 in the development cartridge 31. FIGS. 7A to 7C are views of the window member 64 from three directions. FIG. 8 shows a state in which the window member 64 located in a non-engagement position (which will be described later) is combined with the casing 60. FIGS. 9A and 9B show a state in which the window member 64 located in an engagement position (which will be described later) is combined with the casing 60.

The circular window holes 62 are formed in symmetric positions in the left and right side walls 60A of the casing 60 respectively so as to pierce the left and right side walls 60A. Although FIGS. 6, 8, 9A and 9B show the configuration of the left window hole 62 and its vicinity but do not show the configuration of the right window hole 62 and its vicinity, the configuration of the two window holes 62 and their vicinity in the casing 60 is roughly bilaterally symmetric to each other. Sealing members 63 of the same shape and window members 64 of the same shape are attached into the window holes 62 to thereby block the window holes 62 respectively.

In a circumferential edge portion of each window hole 62, a cylindrical alignment rib 70 (which serves as a "rib") having an inner diameter slightly larger than the diameter of the window hole 62 is formed so as to protrude to the outer surface side (upper side in FIG. 6) of the side wall 60A.

Each sealing member 63 is made of an elastic material such as a moltopren and shaped like a toroid. The sealing member 63 is formed so that the outer diameter of the sealing member 63 is slightly larger than the inner diameter of the alignment rib 70 while the inner diameter of the sealing member 63 is slightly smaller than the inner diameter of the window hole 62. The sealing member 63 is embedded in the inside of the alignment rib 70 while compressed, so that the sealing member 63 is positioned radially.

The window member 64 is made of a light-transmissive synthetic resin material such as polycarbonate. The window member 64 has a transmission portion 71 fitted into the window hole 62, and a flange portion 72 extending annularly outward in the radial direction of the transmission portion 71 or the window hole 62. The transmission portion 71 is a portion through which the detection light transmits. The transmission portion 71 protrudes cylindrically from the flange portion 72 toward the inside of the casing 60 (toward the lower side in FIG. 6). The outer diameter of the transmission portion 71 is set to be slightly smaller than the inner diameter of the window hole 62 and slightly larger than the inner diameter of the sealing member 63. A protrusion end surface 71A of the transmission portion 71 protrudes from the inner wall surface of the casing 60 toward the inside of the casing 60 in the condition that the window member 64 is combined with the window hole 62 (see FIG. 9B), so that the protrusion end surface 71A is cleaned with the wiper 65 provided in the toner storage chamber 39.

A clamp portion 72A is provided in the innermost circumference in a surface of the flange portion 72 on a side opposite to the casing 60. The sealing member 63 is clamped while compressed between the clamp portion 72A and the circumferential edge portion of the window hole 62. An annular escape groove 72B is provided in the radial outside of the clamp portion 72A. An end of the alignment rib 70 can escape into the escape groove 72B. A guide portion 72C which is shaped like a circular arc in sectional view and which can be fitted to the outer circumferential surface of the alignment rib 70 is formed in the radial outside of the escape groove 72B so as to protrude to a region of about two thirds of the outer circumference of the flange portion 72.

A pair of stopped portions 73 stretched like nails toward the radial outside are provided in circumferential opposite end portions in the outer circumferential surface of the flange portion 72, in detail, in the outer circumferential surface of the guide portion 72C. The two stopped portions 73 are provided in point-symmetric positions with respect to the center axis of the transmission portion 71. A pair of rotating operation ribs 74 extending radially with respect to the center axis of the transmission portion 71 (that is, the center axis of the window hole 62) are provided on the outer surface of the flange portion 72 (opposite to the casing 60) so as to be at a distance of about 120 degrees.

On the other hand, a pair of stopper nails 75A and 75B are provided in the outer surface of the side wall 60A so as to be integrated with the side wall 60A. The stopper nails 75A and 75B are disposed in positions which are adjacent to the window hole 62 and where the window hole 62 is radially clamped between the stopper nails 75A and 75B. The stopper nails 75A and 75B are shaped like flat plates extending toward the window holes 62 respectively and are substantially provided in point-symmetric positions with respect to the window hole 62 as its center. Gaps are provided between the stopper nail 75A and the side wall 60A and between the stopper nail 75B and the side wall 60A, respectively. The stopped portions 73 of the window member 64 enter the gaps, so that the stopper nails 75A and 75B are fitted to the stopped portions 73 respectively.

The window member 64 is provided so as to be rotatable around the window hole 62 in the condition that the transmission portion 71 is fitted into the window hole 62. The window member 64 can be displaced between a non-engagement position where the stopped portions 73 do not overlap with the stopper nails 75A and 75B as shown in FIG. 8 and an engagement position where the stopped portions 73 overlap with the stopper nails 75A and 75B as shown in FIG. 9A when the casing 60 is viewed from a side. Incidentally, in the non-engagement position, the transmission portion 71 is allowed to be inserted/removed in/from the window hole 62. In the engagement position, the window member 64 is restricted from being removed from the window hole 62.

A cylindrical bearing rib 76 (which serves as a "stopper") for supporting bearing members not shown but attached to opposite ends of the rotation shaft 61 of the agitator 44 is integrally formed on the side wall 60A of the casing 60 so as to protrude. One stopper nail 75A is integrally connected to the outer circumferential surface of the bearing rib 76. As shown in FIG. 9A, in the condition that the window member 64 is located in the engagement position, the outer circumferential surface of the bearing rib 76 restricts the stopped portion 73 fitted to the stopper nail 75A from rotating counterclockwise.

A circular through-hole 77 through which the detection light passes is formed in the cover 66 for covering the left side surface of the casing 60 so as to be located in a position corresponding to the window hole 62. A flat plate-like locking piece 78 (which serves as a "locking member") extending in a direction perpendicular to the side wall 60A is integrally formed in the cover 66. The cover 66 is combined with the casing 60 after the window member 64 is combined with the casing 60. In this combination state, an end of the locking piece 78 is fitted to the stopped portion 73 located in the engagement position to thereby restrict the window member 64 from rotating from the engagement position to the non-engagement position.

Next, a procedure for attaching the window member 64 to the casing 60 will be described.

First, the sealing member 63 is fitted to the inside of the alignment rib 70 while compressed toward the radial inside. As a result, the sealing member 63 is kept aligned radially with respect to the casing 60. Then, the transmission portion 71 of the window member 64 is pushed into the inside of the sealing member 63. As a result, the sealing member 63 adheres closely to the outer circumferential surface of the transmission portion 71 and to the inner circumferential surface of the alignment rib 70 while compressed between the two.

The window member 64 is further pushed in so that the transmission portion 71 is fitted into the window hole 62. On this occasion, when the window member 64 is pushed in at an angle corresponding to the non-engagement position around the center axis of the window hole 62 as shown in FIG. 8, the stopped portions 73 can be prevented from interfering with the stopper nails 75A and 75B respectively. For this reason, the end of the transmission portion 71 can enter into the window hole 62.

In this manner, in the condition that the end of the transmission portion 71 is fitted into the window hole 62 and the clamp portion 72A of the flange portion 72 abuts on the sealing member 63 (the sealing member 63 is not deformed while compressed), stopped portions 73 cannot rotate to the engagement position because the stopped portions 73 are located in a depth position where the stopped portions 73 overlap the stopper nails 75A and 75B. Therefore, the window member 64 is further pushed into the side wall 60A side from this condition so that the sealing member 63 is deformed while compressed between the clamp portion 72A of the flange portion 72 and the side wall 60A. Then, while the window member 64 is pushed into a depth position where the stopped portions 73 do not interfere with the stopper nails 75A and 75B, the window member 64 is rotated counterclockwise (in the direction of the arrow) in FIG. 8. On this occasion, while the outer circumferential surface of the transmission portion 71 comes into frictional contact with the inner circumferential surface of the window hole 62, the guide portion 72C of the flange portion 72 comes into frictional contact with the outer circumferential surface of the alignment rib 70, so that the posture of the window member 64 in the rotating operation is stabilized. In the rotating operation, a finger, a jig or the like can be put on the rotating operation rib 74 to smoothen the operation.

When the stopped portions 73 go between the stopper nails 75A and 75B and the side wall 60A until the window member 64 reaches the engagement position, one stopped portion 73 abuts on the bearing rib 76 to restrict the window member 64 from rotating any more. Therefore, when pushing-in of the window member 64 is canceled, the window member 64 floats up from the side wall 60A by the elastic restoring force of the sealing member 63 so that the stopped portions 73 are fitted to the stopper nails 75A and 75B while pressed against the stopper nails 75A and 75B. As a result, the window member 64 is held in the casing 60 while the window hole 62 is blocked with the window member 64.

Then, the gear mechanism 69 is combined with the left side surface of the casing 60 and the cover 66 for covering the gear mechanism 69 is fixed by screws. Consequently, as shown in FIGS. 9A and 9B, the locking piece 78 of the cover 66 is fitted to the stopped portion 73 to thereby restrict the window member 64 from rotating to the non-engagement position side.

As described above, in accordance with the embodiment, the stopper nails 75A and 75B are provided near the window hole 62 in the casing 60 and the stopper nails 75A and 75B are fitted to the stopped portions 73 of the window member 64 to keep the window member 64 in a state in which the window hole 62 is blocked with the window member 64. Accordingly, the window member 64 can be attached easily compared with the case where the window member 64 is attached by ultrasonic welding, bonding or the like. Moreover, in the case where the window member 64 is damaged or stained with dust when the development cartridge 31 is to be re-used, the window member 64 can be exchanged for a new one easily compared with another attaching structure.

Moreover, because the stopper nails 75A and 75B are formed so as to be integrated with the casing 60, the positional accuracy of the stopper nails 75A and 75B can be improved while the labor required for assembling can be saved.

Moreover, because the sealing member 63 is disposed between the circumferential edge portion of the window hole 62 and the window member 64, sealing performance can be kept high.

Because the sealing member 63 is made of an annular member having elasticity, the sealing member 63 can be assembled easily compared with the case where a gel type sealing member or the like is used. Moreover, because the sealing member 63 is elastically deformed while compressed between the window member 64 and the circumferential edge portion of the window hole 62, sealing performance can be improved.

The stopper nails 75A and 75B are fitted to the stopped portions 73 of the window member 64 by use of the elastic restoring force of the sealing member 63. Accordingly, because it is unnecessary to provide any other special urging member in order to fit the stopper nails 75A and 75B to the window member 64, configuration can be simplified.

Moreover, because the rib 70 is provided in the circumferential edge portion of the window hole 62 so that the sealing member 63 can be positioned radially, the assembling operation can be smoothened.

Moreover, because the sealing member 63 elastically adheres closely to the outer circumferential surface of the transmission portion 71 protruded from the flange portion 72, sealing performance can be improved.

Moreover, the window member 64 can rotate around the window hole 62 as its center and can be displaced between the engagement position and the non-engagement position by the operation of rotating the window member 64. Accordingly, when the window member 64 is rotated from the non-engagement position to the engagement position on the casing 60, the stopped portions 73 can be fitted to the stopper nails 75A and 75B. Accordingly, because it is unnecessary to flexibly deform the stopper nails 75A and 75B to attach the window member 64, the stopper nails can be prevented from being damaged by mistake.

Moreover, because the window member 64 is rotated while the transmission portion 71 is fitted into the circular window hole 62, the posture of the window member 64 in the rotating operation can be stabilized to smoothen assembling.

Moreover, because the rotating operation rib 74 protruded radially with respect to the center axis of rotation is provided on the outer surface of the window member 64, a finger, a jig or the like can be put on the rib 74 in the rotating operation to improve assembling efficiency.

Moreover, the bearing rib 76 as a stopper for restricting the window member 64 from rotating from the engagement position to a position reverse to the non-engagement position is provided in the casing 60. Accordingly, because the window member 64 is restricted from rotating any more when the window member 64 is rotated from the non-engagement position to the engagement position until the window member 64 reaches the engagement position, the attaching operation can be smoothened.

Moreover, because the locking piece 78 is provided as a locking member for restricting the window member 64 from rotating from the engagement position to the non-engagement position, the window member 64 located in the engagement position can be prevented from dropping out due to unprepared rotation to the non-engagement position side.

Moreover, because the locking piece 78 is provided so as to be integrated with the cover 66 put on the outer surface of the casing 60, it is unnecessary to use any other special parts for restricting the window member 64 from rotating. Accordingly, configuration can be simplified.

Moreover, because the pair of stopper nails 75A and 75B are substantially provided in point-symmetric positions with respect to the rotation axis of the window member 64, the window member 64 can be kept stable with good balance.

Moreover, because the agitator 44 as an agitating member and the wiper 65 as a cleaning member are provided in the casing 60 and the transmission portion 71 protrudes toward the inside of the casing 60, the protrusion end surface of the transmission portion 71 can be cleaned with the wiper 65 surely.

Moreover, because the window member 64 can be attached to the casing 60 from the outside, the window member 64 can be attached easily compared with the case where the window member 64 is attached to the casing 60 from the inside.

Moreover, because the window members 64 of the same shape are attached to the pair of window holes 62 provided in the casing 60, the number of kinds of parts can be reduced. In addition, the window members 64 corresponding to the window holes 62 can be prevented from being attached by mistake.

As described above with reference to the embodiment, due to the stopper nails provided near each window hole in the casing, the stopper nails can be fitted to the stopped portions of the window member so that the window member is held in a state in which the window hole is blocked with the window member. Accordingly, the window member can be attached easily compared with the case where the window member is attached by ultrasonic welding, bonding or the like.

The stopper nails are formed so as to be integrated with the casing. Accordingly, the positional accuracy of the stopper nails can be improved while the labor required for assembling can be saved.

The sealing member is disposed between the circumferential edge portion of the window hole and the window member. Accordingly, sealing performance can be kept high.

The sealing member is made of an annular member having elasticity. Accordingly, the sealing member can be assembled easily compared with the case where a gel type sealing member or the like is used. Moreover, because the sealing member is elastically deformed while compressed between the window member and the circumferential edge portion of the window hole, sealing performance can be improved.

The stopper nails are fitted to the stopped portions of the window member by use of the elastic restoring force of the sealing member. Accordingly, because it is unnecessary to provide any other special urging member in order to fit the stopper nails to the window member, configuration can be simplified.

The rib is provided in the circumferential edge portion of the window hole so that the sealing member can be positioned radially. Accordingly, the assembling operation can be smoothened.

The sealing member elastically adheres closely to the outer circumferential surface of the transmission portion protruded from the flange portion. Accordingly, sealing performance can be improved.

The window member is provided to be rotatable around the window hole as its center and can be displaced between the engagement position and the non-engagement position by the operation of rotating the window member. Accordingly, when the window member is rotated from the non-engagement position to the engagement position on the casing, the stopped portions can be fitted to the stopper nails. Accordingly, because it is unnecessary to flexibly deform the stopper nails to attach the window member, the stopper nails can be prevented from being damaged by mistake.

The window member is rotated while the transmission portion is fitted into the circular window hole. Accordingly, the posture of the window member in the rotating operation can be stabilized to smoothen assembling.

The rotating operation rib protruded radially with respect to the center axis of rotation is provided on the outer surface of the window member. Accordingly, a finger, a jig or the like can be put on the rib in the rotating operation to improve assembling efficiency.

The stopper for restricting the window member from rotating from the engagement position to a position reverse to the non-engagement position is provided in the casing. Accordingly, because the window member is restricted from rotating any more when the window member is rotated from the non-engagement position to the engagement position until the window member reaches the engagement position, the attaching operation can be smoothened.

The locking member is provided for restricting the window member from rotating from the engagement position to the non-engagement position. Accordingly, the window member located in the engagement position can be prevented from dropping out due to unprepared rotation to the non-engagement position side.

The locking member is provided so as to be integrated with the cover put on the outer surface of the casing. Accordingly, it becomes unnecessary to use any other special parts for restricting the window member from rotating. Accordingly, configuration can be simplified.

The pair of stopper nails are substantially provided in point-symmetric positions with respect to the rotation axis of the window member. Accordingly, the window member can be kept stable with good balance.

The agitating member and the cleaning member are provided in the casing and the transmission portion protrudes toward the inside of the casing. Accordingly, the protrusion end surface of the transmission portion can be cleaned with the cleaning member surely.

The window member can be attached to the casing from the outside. Accordingly, the window member can be attached easily compared with the case where the window member is attached to the casing from the inside.

The window members of the same shape are attached to the pair of window holes provided in the casing. Accordingly, the number of kinds of parts can be reduced. In addition, the window members corresponding to the window holes can be prevented from being attached by mistake.

The invention is not limited to the embodiment explained in the aforementioned description and the drawings. For example, the following embodiments may be included in the technical scope of the invention and various changes other than the following embodiments may be made without departing from the gist of the invention.

(1) Although the aforementioned embodiment is configured so that the window member is rotated relative to the window hole to fit the engagement nails to the stopped portions, the invention is not limited thereto. For example, while the stopper nails or the stopped portions are bent, the window member may be fitted into the window hole so that the two can be engaged with each other by use of the elastic restoring force of the stopper nails or the stopped portions.

(2) Although the aforementioned embodiment has been described on the case where the stopper nails are formed so as to be integrated with the casing, the invention may be applied to the case where the stopper nails are provided separately from the casing.

(3) Although the aforementioned embodiment has been described on the case where an elastic member is used as the sealing member, the invention is not limited thereto. For example, a gel type member may be used as the sealing member.

What is claimed is:

1. A developer cartridge comprising:

a casing that stores a developer and is provided with a window hole;

a stopper nail provided adjacent to the window holes; and a window member having a transmission portion that transmits light passing through the window hole, and a stopped portion in which the stopper nail is fitted, wherein the window member is closely retained in the window hole by fitting the stopper nail in the stopped portion, wherein the window member is fitted to the window hole to be rotatable around a center of the window hole, and wherein the window member is configured to be moved by rotating between an engagement position where the stopped portion is fitted to the stopper nail and a non-engagement position where the stopped portion is unfitted to the stopper nail.

2. The developer cartridge according to claim 1, wherein the stopper nail is formed integrally with the casing.

3. The developer cartridge according to claim 1 further comprising a sealing member that is disposed between a circumferential edge portion of the window hole and the window member, and seals therebetween.

4. The developer cartridge according to claim 3, wherein the sealing member is made of an annular member having elasticity, and wherein the sealing member elastically deforms while compressed between the window member and the circumferential edge portion of the window hole.

5. The developer cartridge according to claim 4, wherein the window member has a flange portion stretched radially outward with respect to the window hole to elastically deform while compressing the sealing member between the flange portion and the circumferential edge portion, and wherein the stopped portions and the stopper nails are fitted to each other while pressed against each other by an elastic restoring force of the sealing member.

6. The developer cartridge according to claim 5, wherein the circumferential edge portion is provided with a rib that positions the sealing member in radial direction.

7. The developer cartridge according to claim 5, wherein the transmission portion is fitted in the window hole while protruding from the flange portion to the window hole, and wherein the sealing member elastically abuts closely to an outer circumferential surface of the transmission portion.

8. The developer cartridge according to claim 1, wherein the window hole has a circular sectional shape, and wherein the window member is provided to be rotatable while the transmission portion is fitted in the window hole.

9. The developer cartridge according to claim 1, wherein the window member is provided with a rotating operation rib that protrudes radially with respect to a center axis of the rotating operation, the rotating operation rib being provided on an outer surface of the window member.

10. The developer cartridge according to claim 1, wherein the casing is provided with a stopper that prevents the window member from rotating from the engagement position toward a position further away from the non-engagement position.

11. The developer cartridge according to claim 1 further comprising a locking member that prevents the window member from rotating from the engagement position to the non-engagement position.

12. The developer cartridge according to claim 11, wherein the casing is provided with a gear mechanism in an outer surface thereof, and a cover that covers the gear mechanism, the cover being detachably provided, and wherein the locking member is integrally provided with the cover.

13. The developer cartridge according to claim 1, wherein a pair of stopper nails are provided for the window member, and wherein the pair of stopper nails are substantially provided in point-symmetric positions with respect to the center of the window hole.

14. The developer cartridge according to claim 1, wherein the casing is provided therein with an agitating member that agitates the developer and a cleaning member that moves in conjunction with the agitating member, and wherein the transmission portion is formed to protrude inward from an inner wall surface of the casing and a protrusion end surface thereof is to be cleaned by the cleaning member.

15. The developer cartridge according to claim 1, wherein the window member is provided to be attachable to the casing from outside of the casing.

16. The developer cartridge according to claim 1, wherein the casing is provided with a pair of the window holes through which detection light for detecting residual amount of the developer passes, and wherein each of the window holes is respectively mounted with the window member having substantially the same shape.

17. An image forming apparatus comprising:

a feeder section that feeds a sheet;

an image forming section that forms an image on the sheet fed by the feeder section using a developer; and a developer cartridge including:

a casing that stores a developer and is provided with a window hole;

a stopper nail provided adjacent to the window holes; and a window member having a transmission portion that transmits light passing through the window hole, and a stopped portion in which the stopper nail is fitted, wherein the window member is closely retained in the window hole by fitting the stopper nail in the stopped portion, wherein the window member is fitted to the window hole to be rotatable around a center of the window hole, and wherein the window member is configured to be moved by rotating between an engagement position where the stopped portion is fitted to the stopper nail and a non-engagement position where the stopped portion is unfitted to the stopper nail.

18. A developer cartridge comprising:

a casing that stores a developer and is provided with a window hole and members;

a stopper nail provided adjacent to the window hole; and a window member having a transmission portion that transmits light passing through the window hole, and a stopped portion in which the stopper nail is fitted;

wherein the window member is closely retained in the window hole by fitting the stopper nail in the stopped portion, and wherein the members are configured to prevent the window member when so retained from moving in directions into and out of the window hole.

19. The developer cartridge according to claim 18, wherein the stopper nail is formed integrally with the casing.

20. The developer cartridge according to claim 18 further comprising a sealing member that is disposed between a circumferential edge portion of the window hole and the window member, and seals therebetween.

21. The developer cartridge according to claim 20, wherein the sealing member is made of an annular member having elasticity, and wherein the sealing member elastically deforms while compressed between the window member and the circumferential edge portion of the window hole.

22. The developer cartridge according to claim 21, wherein the window member has a flange portion stretched radially outward with respect to the window hole to elastically deform while compressing the sealing member between the flange portion and the circumferential edge portion, and wherein the stopped portion and the stopper nail are fitted to each other while pressed against each other by an elastic restoring force of the sealing member.

23. The developer cartridge according to claim 22, wherein the circumferential edge portion is provided with a rib that positions the sealing member in radial direction.

24. The developer cartridge according to claim 22, wherein the transmission portion is fitted in the window hole while protruding from the flange portion to the window hole, and wherein the sealing member elastically abuts closely to an outer circumferential surface of the transmission portion.

25. The developer cartridge according to claim 18, wherein the window member is fitted to the window hole to be rotatable around a center of the window hole, and wherein the window member is configured to be moved by rotating between an engagement position where the stopped portion is fitted to the stopper nail and a non-engagement position where the stopped portion is unfitted to the stopper nail.

26. The developer cartridge according to claim 25, wherein the window hole has a circular sectional shape, and wherein the window member is provided to be rotatable while the transmission portion is fitted in the window hole.

27. The developer cartridge according to claim 25, wherein the window member is provided with a rotating operation rib that protrudes radially with respect to a center axis of the rotating operation, the rotating operation rib being provided on an outer surface of the window member.

28. The developer cartridge according to claim 25, wherein the casing is provided with a stopper that prevents the window member from rotating from the engagement position toward a position further away from the non-engagement position.

29. The developer cartridge according to claim 25 further comprising a locking member that prevents the window member from rotating from the engagement position to the non-engagement position.

30. The developer cartridge according to claim 29, wherein the casing is provided with a gear mechanism in an outer surface thereof, and a cover that covers the gear mechanism, the cover being detachably provided, and wherein the locking member is integrally provided with the cover.

31. The developer cartridge according to claim 25, wherein a pair of stopper nails are provided for he window member, and wherein the pair of stopper nails are substantially provided in point-symmetric positions with respect to the center of the window hole.

32. The developer cartridge according to claim 18, wherein the casing is provided therein with an agitating member that agitates the developer and a cleaning member that moves in conjunction with the agitating member, and wherein the transmission portion is formed to protrude inward from an inner wall surface of the casing and a protrusion end surface thereof is to be cleaned by the cleaning member.

33. The developer cartridge according to claim 18, wherein the window member is provided to be attachable to the casing from outside of the casing.

34. The developer cartridge according to claim 18, wherein the casing is provided with a pair of the window holes through which detection light for detecting residual amount of the developer passes, and wherein each of the window holes is respectively mounted with the window member having substantially the same shape.

35. An image forming apparatus comprising:

a feeder section that feeds a sheet;

an image forming section that forms an image on the sheet fed by the feeder section using a developer; and a developer cartridge including:

a casing that stores a developer and is provided with a window hole and members;

a stopper nail provided adjacent to the window hole; and a window member having a transmission portion that transmits light passing through the window hole, and a stopped portion in which the stopper nail is fitted, wherein the window member is closely retained in the window hole by fitting the stopper nail in the stopped portion, and wherein the members are configured to prevent the window member when so retained from moving in directions into and out of the window hole.

* * * * *

UNITED STATES PATENT AND TRADEMARK OFFICE

CERTIFICATE OF CORRECTION

PATENT NO. : 7,106,982 B2
APPLICATION NO. : 11/172990
DATED : September 12, 2006
INVENTOR(S) : Makoto Ishii It is certified that error appears in the above-identified patent and that said Letters Patent is hereby corrected as shown below:

In Column 19, Claim 31, Line 8:
Please replace "he window" with --the window--

Signed and Sealed this

Twenty-seventh Day of February, 2007

JON W. DUDAS
*Director of the United States Patent and Trademark Office*